United States Patent [19]

Mayne et al.

[11] 4,236,835

[45] Dec. 2, 1980

[54] PRINTER SYSTEM WITH COMPRESSED PRINT CAPABILITY

[75] Inventors: David W. Mayne, San Juan Capistrano; Raymond F. Melissa, Costa Mesa, both of Calif.

[73] Assignee: Printronix, Inc., Irvine, Calif.

[21] Appl. No.: 970,622

[22] Filed: Dec. 18, 1978

[51] Int. Cl.[3] ..... B41J 3/12

[52] U.S. Cl. ..... 400/121; 101/93.04; 400/124

[58] Field of Search ..... 400/121, 124; 101/93.04, 93.05

[56] References Cited

U.S. PATENT DOCUMENTS

| | | | |
|---|---|---|---|
| 3,941,051 | 3/1976 | Barrus et al. | 101/93.04 |
| 3,991,868 | 11/1976 | Robinson et al. | 400/124 |
| 4,050,563 | 9/1977 | Menhennett | 400/124 |
| 4,169,684 | 10/1979 | Blom | 101/93.05 X |

*Primary Examiner*—Paul T. Sewell

*Attorney, Agent, or Firm*—Fraser and Bogucki

[57] ABSTRACT

A dot matrix printer having a reciprocating hammer bank prints characters in either a standard or a compressed size using one of two different sets of modulation bits stored in a character generator for each character. A control code byte preceding each line of characters to be printed selects the sets of modulation bits in the character generator to be used and in addition selects the repetitive counts to be made by two different decoders in response to timing pulses designating the different dot column positions during each sweep of the hammer bank to control the application of the modulation bits from the character generator to actuating mechanisms for the hammers within the hammer bank. The compressed characters are the same height as but of reduced width compared to the standard characters, with the result that each hammer in the hammer bank prints a greater number of compressed characters than standard characters while bidirectionally reciprocating through a fixed distance relative to a paper or other printable medium.

4 Claims, 21 Drawing Figures

FIG. 2A
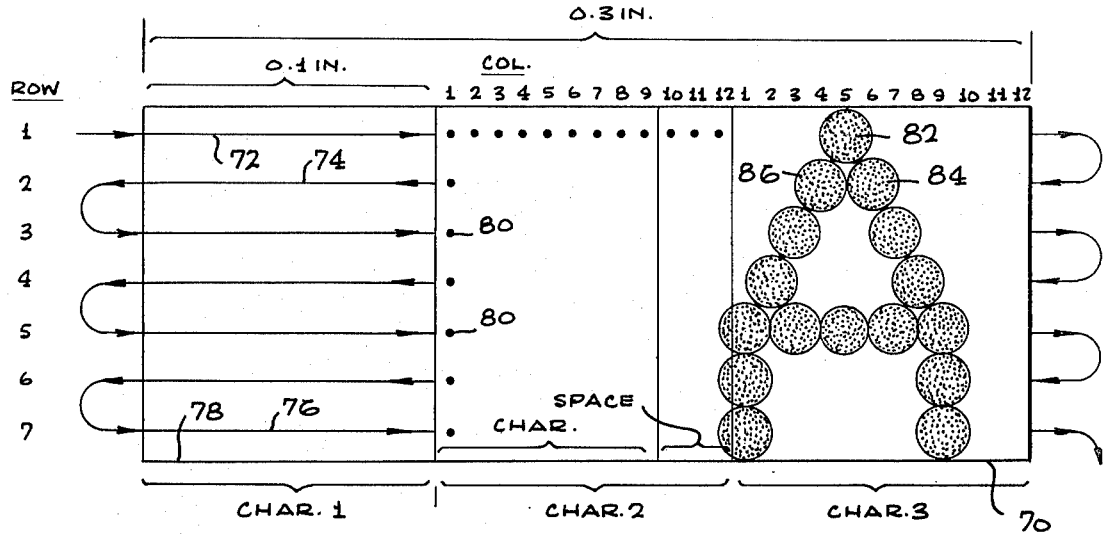
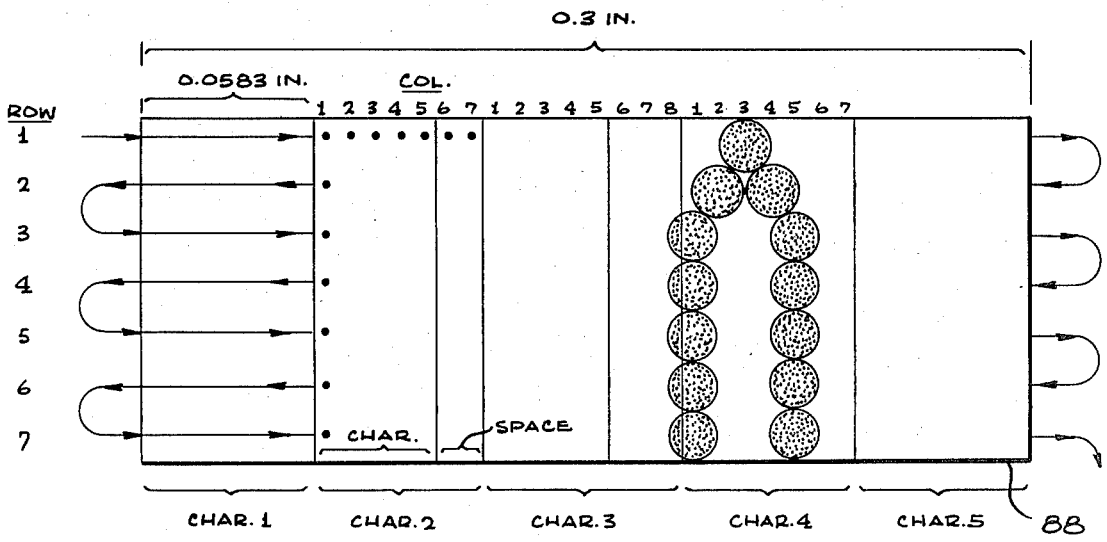
FIG. 2B

PRINTER SYSTEM WITH COMPRESSED PRINT CAPABILITY

BACKGROUND OF THE INVENTION

1. Field of the Invention

The present invention relates to dot matrix printers, and more particularly to dot matrix line printers of the impact type in which the individual hammers of a reciprocating hammer band are selectively impulsed to print lines of characters in dot matrix fashion.

2. History of the Prior Art

It is known in the art to provide dot matrix line printers in which lines of characters are formed by imprinting selected dots within dot matrices on a print paper or other printable medium to form the characters. Such printers may be of the impact type in which hammers, print wires or similar elements movable relative to the paper selectively impact the paper such as through an ink ribbon to print the desired dots. Such printers may also be of the non-impact type such as where an ink jet is periodically directed onto the paper in controlled fashion. Dot matrix line printers offer numerous advantages including relatively high speeds of operation and versatility in the characters that can be printed and the manner in which they are printed.

An example of a dot matrix line printer of the impact type employing a plurality of hammers in a reciprocating hammer bank is provided by U.S. Pat. No. 3,941,051 of Barrus et al, PRINTER SYSTEM, issued Mar. 2, 1976 and assigned to the assignee of the present application. In the printer described in the Barrus et al patent the hammer bank is bidirectionally reciprocated through a fixed distance relative to a length of print paper which is incrementally advanced prior to each sweep of the hammer bank thereacross. Each hammer in the hammer bank prints a selected number of characters in each line by printing a different dot row of the characters with each sweep of the hammer bank across the paper. Modulation bits for the individual hammers are provided by a character generator which stores a different set of bits for each possible character to be printed. Timing of the application of the modulation bits from the character generator to the hammers is controlled by circuitry which responds to sync pulses generated in response to occurrence of the different dot column positions within a line during each sweep of the hammer bank. As each dot column position is entered the series of bytes stored in a recirculating shift register and representing characters to be printed in a given line is recirculated causing the character generator to output the modulation bits corresponding to a particular dot column for each character, the column being determined by the number of the sweep of the hammer bank across the print paper. Application of the outputed modulation bits to the hammers is controlled by counters and related circuitry which first of all select the dot position of each outputed dot row which corresponds to the dot column position of the hammer bank to the exclusion of the other dot positions and secondly selects the bits from the characters which the hammers are addressing to the exclusion of bits from other characters.

The printer described in Barrus et al prints each of the characters within a dot matrix of fixed size. Thus, in one practical example each character is printed within a space in the dot matrix measuring 7 dots high by 6 dots wide. The last three half dot column positions of the 12 half dot positions defining the 6 dot width of such space are not printed in order to provide space between the character and the immediately following character. Consequently each character is printed within a dot matrix measuring 7 dots high and 5 dots wide with the 5 dot width being defined by 9 half dot positions.

For certain applications and for greater versatility of application of printer systems such as that shown in Barrus et al it would be advantageous to be able to vary the size of the characters by varying the size of the dot matrix, and particularly to be able to vary the character size during actual operation of the printer without changing the speed of the hammer bank or other parameters so as to be able to print a given group of characters in their standard size or optionally in a compressed size. For example, during a given printing operation certain forms may dictate the use of compressed print in some or all portions thereof for reasons such as space limitations. Accordingly, it would be desirable to provide a printer capable of printing one or more groups of characters in a plurality of different sizes as the situation demands. The printer should desirably be capable of choosing between the different sizes quickly and during the occurrence of a printing operation and without the need for changing the basic system parameters.

BRIEF DESCRIPTION OF THE INVENTION

Printer systems in accordance with the invention enable the printing of a given set of characters in a plurality of different sizes using a print line dot matrix of given size and a fixed sweep speed of the paper or other printable medium. Representations of groups of characters to be printed are accompanied by an indication of character size which chooses the appropriate one of a plurality of different sets of modulation bits stored within a character generator for each character. The appropriate sets of modulation bits for the characters to be printed are repeatedly addressed in response to the occurrence of each new sync pulse representing the addressing of a new dot column position of the line dot matrix by each of a plurality of hammers in a bidirectional, reciprocating hammer bank. As each set of modulation bits within a character generator is addressed, the bits thereof corresponding to the dot row being swept by each of the hammers are provided to a multiplexer. The multiplexer selects the bit from the dot row which corresponds to the dot column position being addressed by the hamers. This is determined by a dot column decoder which repeatedly counts in response to the sync pulses to one of a plurality of different values as determined by the indication of the size of the characters to be printed. The dot column decoder enables the multiplexer to select the modulation bit within the appropriate dot column position for outputing to a gating circuit.

The gating circuit controls the passage of modulation bits to impulse the hammers within the hammer bank in accordance with the particular characters being addressed by the various hammers. Since the arrangement of the printer is such that each hammer addresses a plurality of different characters during a given sweep, it is necessary to identify the character being addressed by each hammer at a given instant so that modulation bits corresponding to the other characters can be excluded by the gating circuit. This is accomplished in accordance with the invention by use of a character column decoder which repeatedly counts to predetermined values in response to the sync pulses and as determined by the indication of size of the characters to be printed. This information is compared with the output of a counter which repeatedly counts to predetermined numbers in response to recirculation of the representations of characters to be printed and in accordance with the indication of character size.

BRIEF DESCRIPTION OF THE DRAWINGS

The foregoing and other objects, features and advantages of the invention will be apparent from the following more particular description of a preferred embodiment of the invention, as illustrated in the accompanying drawings, In which:

FIG. 2A is a graphical representation of a portion of a print line illustrating the manner in which a character of conventional size is printed in dot matrix fashion;

FIG. 2B is a graphical representation of a portion of a print line illustrating the manner in which a character of compressed size is printed in dot matrix fashion;

DETAILED DESCRIPTION

Figure 1:
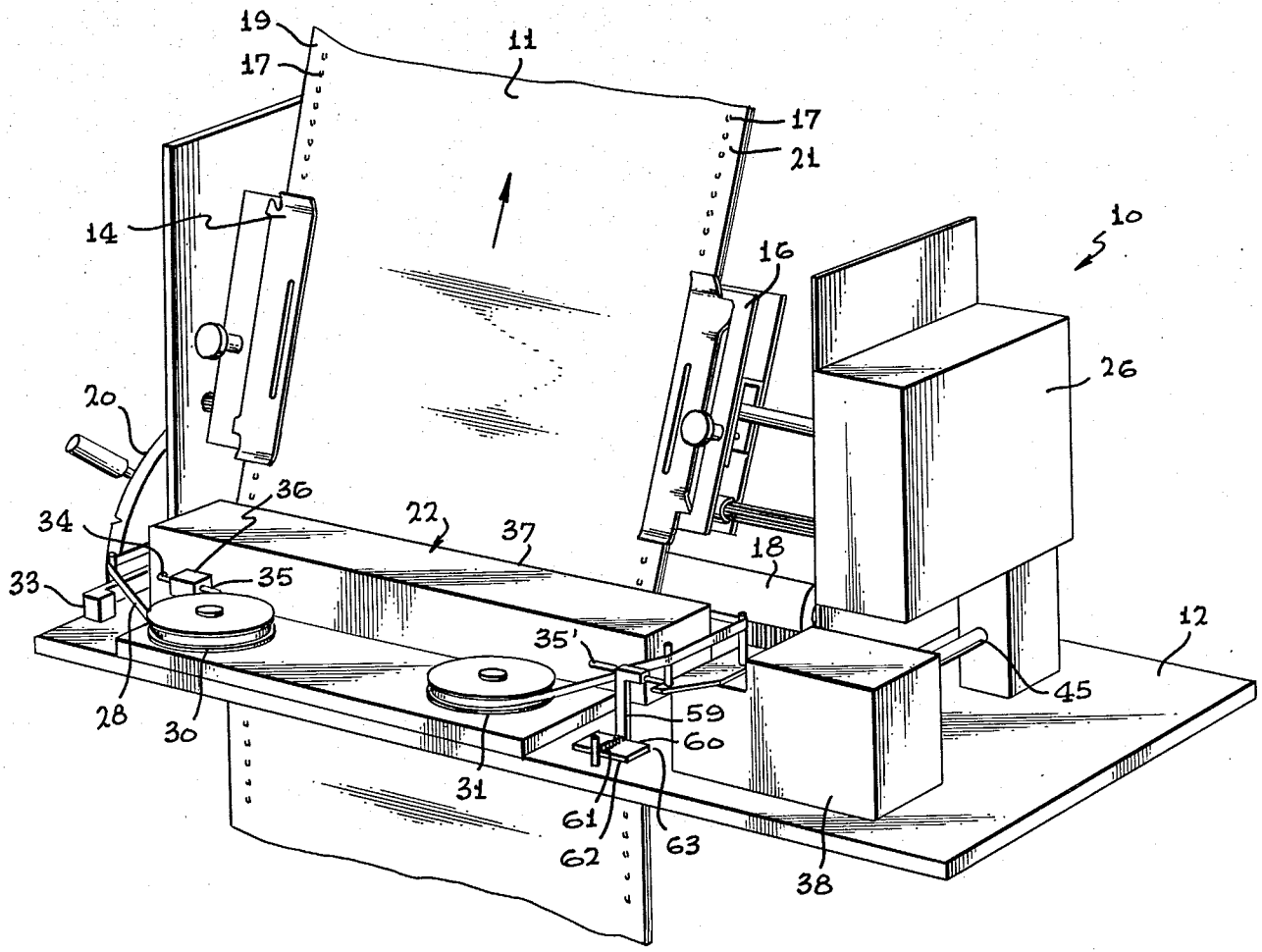
FIG. 1 is a perspective view of a printer in accordance with the invention.

FIG. 1 depicts a printer 10 in accordance with the invention. Since most of the mechanical details of the printer 10 of FIG. 1 are identical to those shown and described in detail in previously referred to U.S. Pat. No. 3,941,051 of Barrus et al, such common components will be only briefly described herein. Moreover, it will be understood by those skilled in the art that while the invention is described herein in conjunction with a dot matrix line printer using impacting hammers, the principles thereof pertain to other types of printers.

The mechanical arrangement of the printer 10 shown in FIG. 1 and described more fully in the Barrus et al patent comprises a page printer for data processing systems, operating typically at about 300 lines per minute and printing an original and a substantial number of clear carbon copies. The paper or other imprintable medai 11 comprises one or a number of webs of conventional edge perforated, continuous or fan-folded sheet fed upwardly through a base frame 12 and past a horizontal printing line position at which printing takes place. The original and carbon sheets are advanced together past the printing line by known tractor drives 14, 16, engaging edge sprocket perforations 17 along the two margins 19 and 21 of the paper. Just below the printing line, the paper 11 is held flat, under controlled tension and in registration, without entrapped air pockets against a platen 18, by a paper thickness adjustment control 20.

At the printing line, a shuttle mechanism 22 includes a hammer mechanism which is horizontally reciprocated to span a desired number of character column positions. This example assumes that there are to be 132 character positions or columns across the paper 11 for the normal or standard character size, and a bank of 44 hammers is employed, with the lateral travel of the shuttle mechanism 22 thus being sufficiently wide (0.3" in this example) for each hammer to move across three different adjacent columns. The various hammers of the bank 23 which are spaced apart along the length thereof adjacent the paper 11 are not shown in FIG. 1 for reasons of clarity. Each of the hammers, when actuated, moves forward under spring tension causing an included printing tip to impact an ink ribbon 28 against the paper 11 long enough to cause the impression of the printing tip to print on the paper 11, following which the hammer returns to its initial position. The various hammers are operated concurrently during the reciprocating motion to write selectively spaced dots within a horizontal dot matrix line in each of the three associated character columns for each hammer in the case of standard character size. The paper 11 is then advanced by a stepping motor mechanism 26 to the next horizontal matrix line position. Thus the system concurrently writes different character segments in serial dot row fashion, first in one direction and then in the other.

At the printing line position, the ribbon 28 is interposed between the shuttle mechanism 22 and the paper 11, the ribbon 28 being advanced by supply and take-up reels 20, 31. Vertical shuttle support elements 33 mounted on the base frame 12 include linear bearings 34 for receiving horizontal support shafts 35, 35'. The shafts 35, 35' are coupled by brackets 36 to a horizontal channel member defining a housing 37 for the shuttle mechanism 22.

The hammer mechanism within the shuttle mechanism 22 is reciprocated by a cam assembly 38 described in detail in the Barrus et al patent. A rotatable cam follower engages the periphery of a double lobed cam which is rotated by a shaft 45 coupled to a flywheel and drive system (not shown). On the opposite side of the cam from the first cam follower, and in axial alignment therewith, a second rotatable cam follower also engages the cam periphery. The second cam follower is mounted within a counterweight structure rotatable about an axis substantially parallel to the axis of the shaft 45. The second cam follower is spring biased into constant engagement with the cam.

For ease of feeding the paper 11 past the printing line position, the shuttle mechanism 22 is pivotably rotatable about the off-axis support shafts 35, 35' at the brackets 36. However, the shuttle mechanism 22 is normally held at its printing position under the force exerted by a tension spring 61 coupling the dependent bracket 59 on the shaft 35' to the frame 12. A limit stop position for the bracket 59 is defined by engagement of a friction bearing element 60 against a linear surface 63 defined by a reference member 62 mounted on the frame 12. The entire shuttle mechanism 22 can therefore pivot about the axis of the shafts 35, 35' away from the printing line position so as to provide greater clearance between the hammer tips and the facing paper 11 to gain access to the hammer mechanism for cleaning.

As the shuttle mechanism 22 reciprocates back and forth to effect printing, the ribbon 28 is driven past the paper 11 and the platen 18, first in a direction from the reel 30 to the reel 31, and then in the reverse direction from the reel 31 to the reel 30. Each time the ribbon 28 is unwound to its end on one of the reeld 30, 31, the condition is sensed and the direction of drive is reversed. In this manner usage and wear of the ribbon 28 are distributed throughout the entire length of the ribbon 28, while at the same time fresh portions of the ribbon 28 are constantly available for the various hammers as they impact the ribbon 28 against the paper 11.

FIG. 2A depicts a portion of a print line 70 on the paper 11 which is printed by one of the hammers of the shuttle mechanism 22. In the present example the print line portion shown in FIG. 2A is 0.3" long, which distance is equal to the length of each reciprocating sweep of the shuttle mechanism 22. Accordingly, the print line 70 is divided into a succession of 0.3" long portions along the length thereof with each portion being printed by a different one of the hammers. The print line 70 comprises one continuous matrix of dots which is formed into 7 horizontal dot rows and a plurality of vertical dot columns. The portion of the print line 70 shown in FIG. 2A is printed by the associated hammer which starts at the top and sweeps from left to right to print a first dot row 72. At the end of the 0.3" sweep, the shuttle mechanism 22 is reversed and sweeps from right to left to print a second dot row 74. The second dot row 74 is disposed below the first dot row 72 by a full dot position due to the incremental upward advance of the paper 11 relative to the hammers during the turnaround between the left to right sweep and the right to left sweep. The shuttle mechanism 22 continues sweeping back and forth until the last dot row 76 is printed during a sweep from left to right. At the end of the dot row 76 the shuttle mechanism 22 sweeps from right to left. During this right to left sweep no printing is done and instead the paper is advanced upwardly relative to the hammers of the shuttle mechanism 22 in preparation for printing the next line of characters.

FIG. 2A depicts the case where characters of standard size are printed. Accordingly the print line 70 is divided into a sequence of character blocks or cells 78 which are each 0.1" in length and equal in height to the height of the print line 70. Accordingly, the portion of the print line 70 shown in FIG. 2A comprises three different character blocks or cells designated as accommodating char. 1, char. 2 and char. 3. The location of the dot rows and columns is illustrated within the char. 2 space. A series of points 80 adjacent the left hand margin of this space represent the dot positions of the seven different dot rows including the rows 72, 74 and 76 within the first dot column. As previously noted the various dot rows such as the rows 72, 74 and 76 are separated from each other by a full dot position. On the other hand the dot column positions which are numbered across the top of the char. 2 space comprise half-dot positions as they are separated from one another by a half-dot position. As shown in FIG. 2A there are 12 dot column positions comprising each character block or cell 78. The first nine dot column positions comprising the left hand and central portions of each character block or cell 78 are for the character itself, while the right hand dot column positions 10, 11 and 12 remain free of printing to provide a space between the character and the immediately following character in the line. The printed dots in the present example are 0.02" in diameter so as to slightly overlap dots in the adjacent full dot positions. Printing is carried out in such a way that dots are never printed in a pair of immediately adjacent half-dot positions within the dot columns. Thus if a dot is printed in the first dot column position of the first dot row, the next dot in the same row cannot be printed in the second dot column position but can be printed in the third dot column position. The reason for the presence of 12 half-dot column positions rather than six full-dot column positions within each character block or cell 78 is to provide flexibility in where the various dots comprising a character can be located.

The letter "A" is shown in the char. 3 character block or cell of FIG. 2A. The topmost dot 82 is printed by the hammer in the No. 5 dot column position of the first dot row 72 during the first sweep of the hammer from left to right. During the following sweep of the hammer from right to left, the next two dots 84 and 86 are printed in the No. 6 and the No. 4 dot column positions respectively of the second dot row 74, thereby observing the rule that dots are never printed in adjacent dot column positions of the same row. Printing of the "A" continues with successive sweeps of the hammer until the last dot row 76 is printed.

In accordance with the invention each 0.3" long portion of the print line 70 can be divided into a greater number of character blocks or cells so as to print characters of reduced or compressed width without altering such basic parameters of the printer as the sweep speed of the shuttle mechanism 22, the size and layout of the dot rows and columns and the amount and frequency of paper advance. In the example of FIG. 2B the 0.3" long portion of the print line 70 is divided into five different character blocks or cells 88. Each of the cells 88 has the same height and the same full dot spacing of the seven different dot rows as in the example of FIG. 2A. However the width of each cell 88 in FIG. 2B is reduced from 12 to 7 dot column positions. The first five dot column positions in the left and central portions of each character cell 88 define the space in which the character is printed, while the 6th and 7th dot column positions at the right hand portion of the cell 88 are left blank to provide a space between the character and the immediately following character in the line. The printed letter "A" is shown in the fourth or char. 4 character cell of the example of FIG. 2B. It will be seen that the letter "A" has the same height as in the example of FIG. 2A but has been compressed in width by confining the dots to the first five dot column positions of the character cell.

The standard size characters of FIG. 2A each require 0.1" of paper width to print so that a maximum of 132 characters can be printed in a line just over 13" long across the paper 11. In the compressed print example of FIG. 2B each character requires only 0.0583" of paper width and therefore up to 220 characters can be printed in the same size line or up to 132 characters in a line less than 8" long. This represents a substantial cost savings in terms of such things as paper of reduced width while at the same time presenting 132 character columns in a manageable format.

In the example of FIG. 2A each of the three character cells 78 comprises 12 dot column positions for a total of 36 dot column positions across the portion of the print line 70 printed by each hammer. The print line portion shown in FIG. 2B is of equal size and also consists of 36 dot column positions across the width thereof. However because each character cell 88 is only 7 dot columns in width for a total of 35 dot columns for the five character cells, it is necessary to provide for the extra or leftover dot column. This is accomplished by making the 3rd or char. 3 character cell eight dot columns in width and therefore making the space following that character three dot columns in width instead of two. The slightly larger space following the third one of each group of five characters is barely noticeable and has been found to be unobjectionable for virtually all applications of the compressed print format.

A five character arrangement of compressed print as shown in FIG. 2B is described herein for purposes of example only, and it will be understood by those skilled in the art that other compressed print arrangements are possible in lieu of or in addition to that shown in FIG. 2B. For example, the 36 dot column positions can be divided into four character cells, each of which is 9 dot columns in width. In such instances the 6 dot column positions at the left and central portion of each character cell are used for the character and the right hand 3 dot column positions are used to provide the space following the character.

Figure 3:
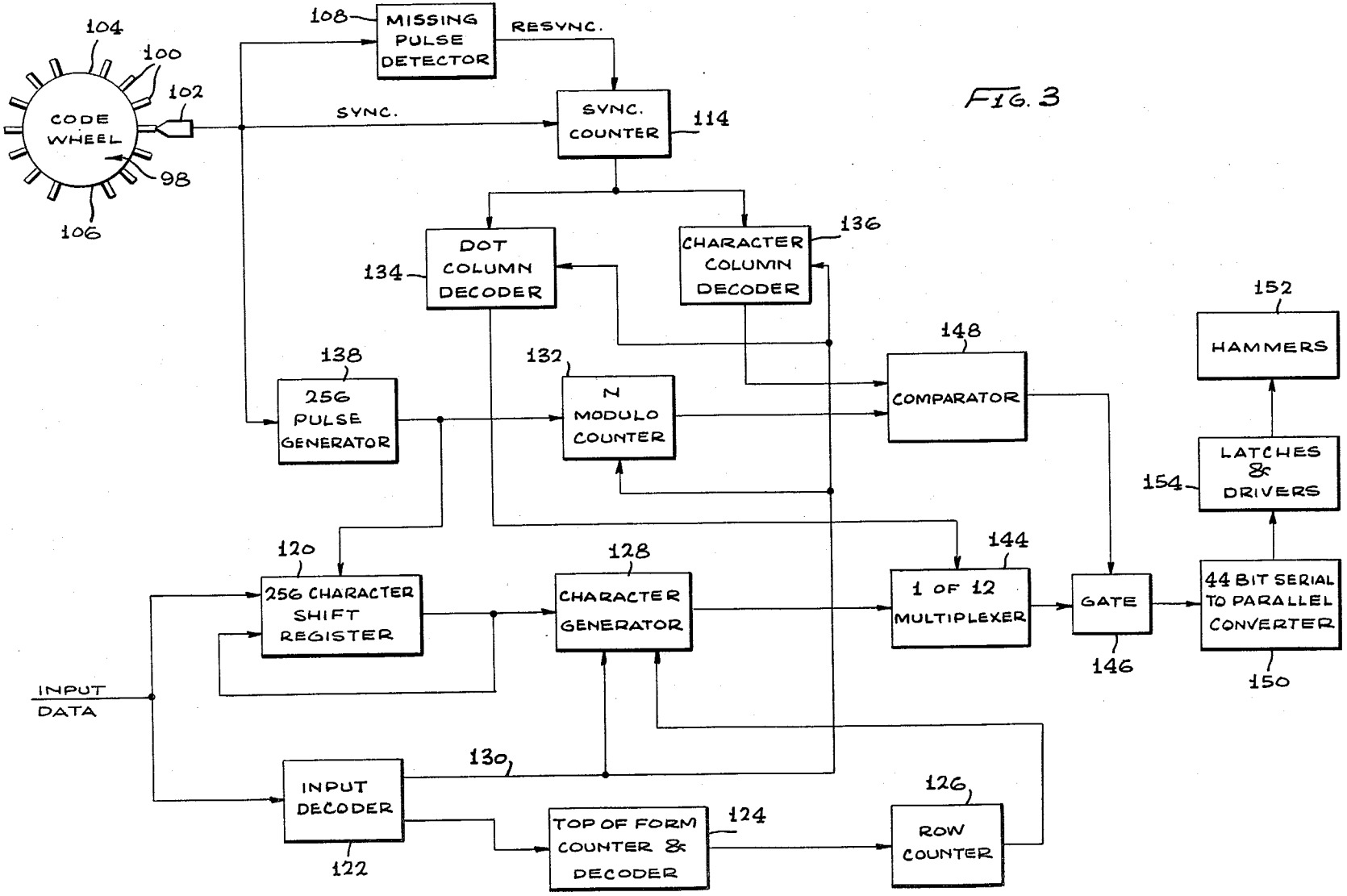
FIG. 3 is a block diagram of circuitry forming a part of the printer of FIG. 1.

FIG. 3 depicts an arrangement of circuitry for enabling the printer 10 of FIG. 1 to print in either the standard print size of FIG. 2A or the compressed print size of FIG. 2B. The waveforms of FIGS. 4A–4G, 5A–5F and 6A–6D help to understand the operation of the circuit of FIG. 3. Referring momentarily to FIG. 1, the stepping motor mechanism 26 includes a code wheel for controlling the operation of the cam assembly 38. The code wheel 98 which is shown in FIG. 3 determines the speed of reciprocation of the shuttle mechanism 22 and therefore provides an accurate time reference with respect to the positions of the various hammers across the width of the print line. The outer periphery of the code wheel 98 includes a plurality of teeth 100 which move past a magnetic pickup 102 as the code wheel 98 rotates. The magnetic pickup 102 responds to the teeth 100 by generating a sync pulse or signal in response to the occurrence of each tooth. The timing is such that a new sync pylse occurs at the beginning of each dot column position across the width of the print line 70.

Figures 4A, 4B, 4C, 4D, 4E, 4F, 4G:
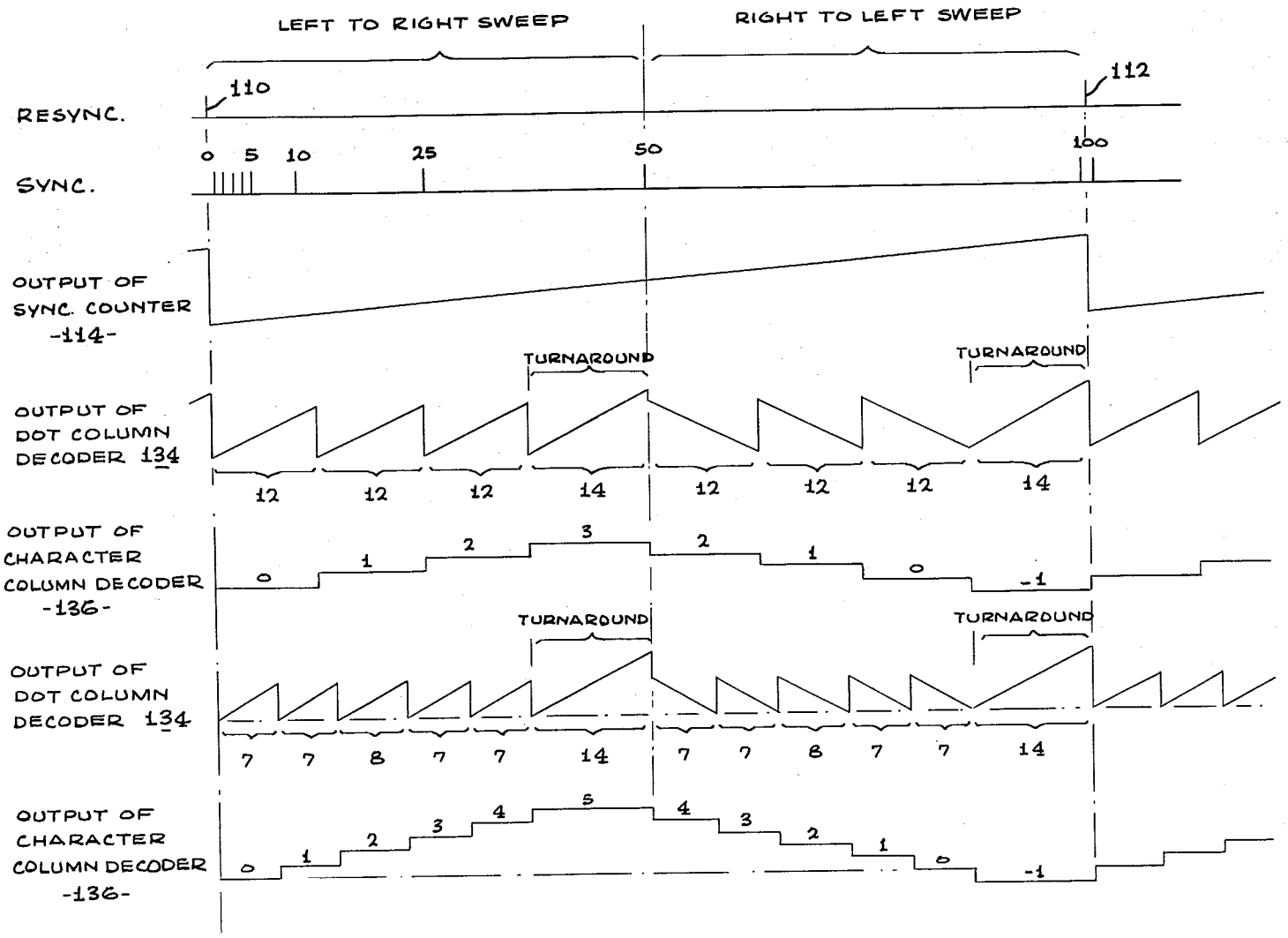
FIGS. 4A–4G are waveforms useful in explaining the operation of the circuitry of FIG. 3.

The code wheel 98 has a missing tooth at a first portion 104 thereof and a missing tooth at an opposite second portion 106 thereof. When the magnetic pickup 102 encounters either of the portions 104 or 106, the absence of a sync pulse is detected by a missing pulse detector 108 which responds by generating a resync pulse. These resync pulses which occur at the beginning of each sweep of the shuttle mechanism 22 from left to right are shown in FIG. 4A. FIG. 4A depicts a first resync pulse 110 which is produced by either the portion 104 or the portion 106 of the code wheel 98. The shuttle mechanism 22 then sweeps from left to right, turns around and sweeps from right to left. Following turnaround the shuttle mechanism 22 again begins a sweep from left to right upon the occurrence of a resync pulse 112. Since each of the portions 104 and 106 of the code wheel 98 produces a resync pulse, the shuttle mechanism 22 sweeps back and forth across the paper 11 twice for each revolution of the code wheel 98.

FIG. 4B shows the sync pulses produced by the teeth 100 of the code wheel 98. There are enough teeth between each of the opposite portions 106 and 108 to divide each half of the code wheel into 100 sync pulse intervals. As seen in FIG. 4B sync pulses occur so as to divide each sweep of the shuttle mechanism 22 from left to right into 50 different sync pulse intervals or dot column positions. Likewise, each sweep from right to left is also divided into 50 different dot column positions.

Figures 5A, 5B, 5C, 5D, 5E, 5F:
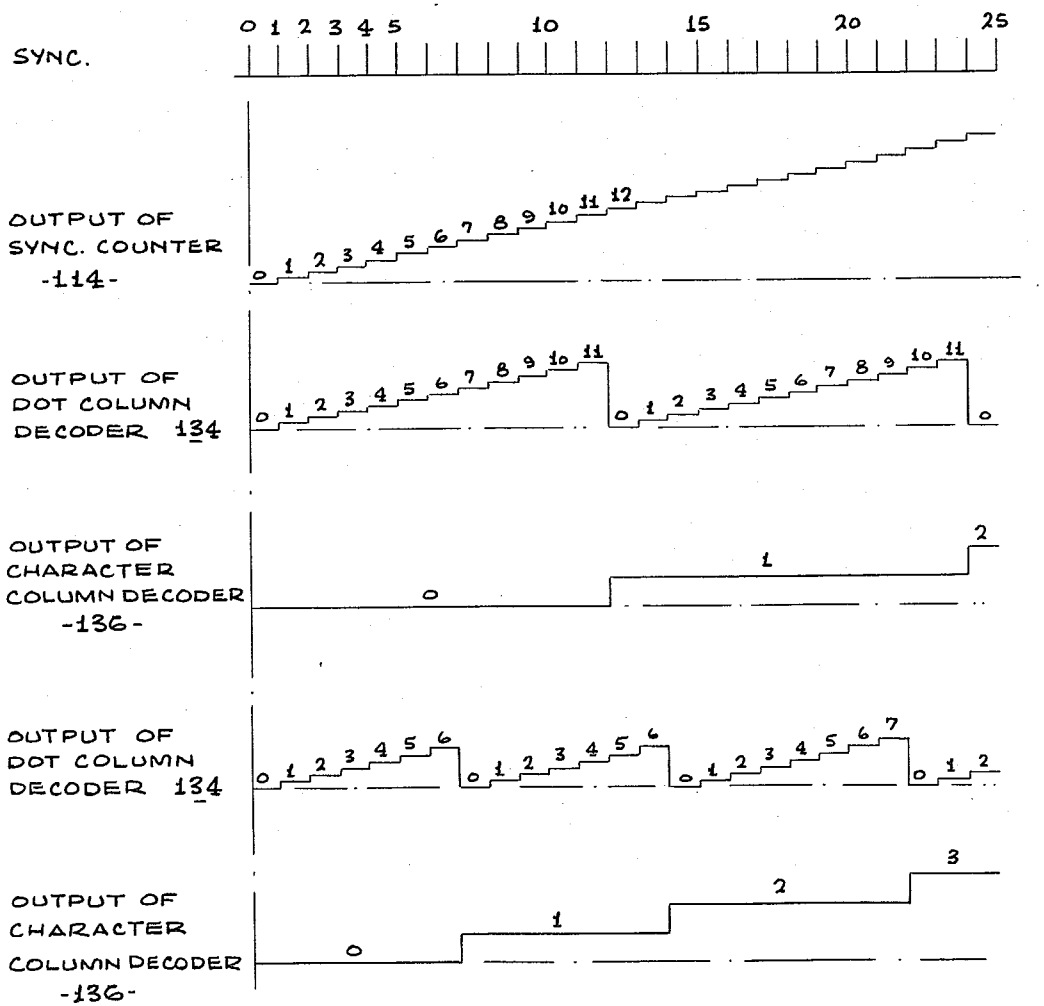
FIGS. 5A–5F are further waveforms useful in explaining the operation of the circuitry of FIG. 3.

A sync counter 114 counts the sync pulses between being reset by the resync pulses. The sync counter 114 has a binary weighted output which is shown in simplified form in FIG. 4C and in more detailed form in FIG. 5B. Referring to FIG. 4C it will be seen that upon occurrence of the resync pulse 110 the sync counter 114 is reset to 0 and begins counting up in response to each sync pulse. The sync counter 114 continues to count up until the occurrence of the next resync pulse 112, at which point it is reset to 0 and again begins to count up. FIG. 5A shows a sequence of 25 sync pulses following the occurrence of a resync pulse. As seen in FIG. 5B the binary weighted output of the sync counter 114 begins at 0 and increases incrementally to the next higher count value upon the occurrence of each sync pulse. Input data is applied to the circuitry of FIG. 3 in the form of sequences of 7-bit bytes. Each sequence of 7-bit bytes which represents a line of characters to be printed on the paper 11 is stored in a 256 character shift register 120. The sequence of bytes is accompanied by several control code bytes denoting information with respect to the details and special instructions for printing the line. An input decoder 122 responds to the control code bytes to set up the circuitry of FIG. 3 for printing of the incoming line. A top of form counter and decoder 124 contains a counter which is reset each time a control code byte indicates that the line of characters received is to be the first line at the top of a new page. The counter is then advanced as the control code bytes of subsequent lines of characters denote subsequent lines on the page. A row counter 126 is reset in response to each new line of characters and is incremented upon completion of each sweep of the shuttle mechanism 22 to keep a count of the number of the dot row being printed by the hammers. This dot row indication is provided to a character generator 128 coupled to the output of the 256 character shift register 120.

Each incoming line of characters to the 256 character shift register 120 is accompanied by a control code byte indicating the size of the characters to be printed. The input decoder 122 responds to the control code byte by providing at an output 130 thereof a signal indicating whether the characters are to be printed in standard size as shown in FIG. 2A or in compressed print size as shown in FIG. 2B. This signal is provided to the character generator 128, to an N modulo counter 132, to a dot column decoder 134 and to character column decoder 136. The dot column decoder 134 and the character column decoder 136 comprise arrangement of programmable read only memories (PROMS) which repeatedly count up to a predetermined number in response to the binary weighted output of the sync counter 114, the predetermined number being determined by the character size signal from the input decoder 122. The resulting output of the dot column decoder 134 for the standard size print of FIG. 2A is shown in FIG. 4D and for the compressed print of FIG. 2B is shown in FIG. 4F. Referring to FIG. 4D, it will be seen that the dot column counter 134 responds to the increasing count of the sync counter 114 following the occurrence of the resync pulse 110 by counting from 0 to 11 and then being reset to 0 three different times. This results from the action of the PROMS within the dot column decoder 134 which are utilized when printing of standard size characters is indicated. After the decoder 134 counts to 11 and is then reset three different times so as to define the 12 different dot column positions for the three different character cells to be printed by the sweep, the decoder 134 performs a count of 14 to define a turnaround interval. During this turnaround interval the shuttle assembly 22 which has completed the sweep from left to right is turned around in preparation for the sweep from right to left. During the sweep from right to left, the decoder 134 counts down 12 different dot column positions three different times, to again identify the three different characters being printed. Following that the decoder 134 performs a count of 14 to define a further turnaround interval, during which time the shuttle assembly 22 which has completed its sweep from right to left is turned around in preparation for the next sweep thereof from left to right.

The output of the dot column decoder 134 which is depicted in FIG. 4D is shown in greater detail in FIG. 5C. As seen in FIG. 5C the output is incrementally stepped to a different value in response to the changing output of the sync counter 114. At the end of each count of 12 the decoder 134 is reset to 0 and begins to count upwardly again.

If the output signal from the input decoder 122 indicates that the characters are to be printed in compressed print size, a different set of PROMS within the dot column decoder 134 is caused to respond to the output of sync counter 114 by repeatedly counting through a predetermined number of counts. As seen in FIG. 4F the decoder 134 responds to the occurrence of the resync pulse 110 by counting up seven times and then being reset to 0. After this occurs twice so as to define the 7 dot column positions of the first two characters, the PROMS within the decoder 134 then cause the decoder 134 to count up by a count of 8 to provide the char. 3 character cell 88 which is shown in FIG. 2B and which includes the extra dot column space leftover after 35 dot column positions are accounted for by the five characters. The decoder 134 then performs two more counts of 7 to define the dot column positions of the 4th and 5th characters, following which the decoder 134 provides a count up of 14 from 0 to define the turnaround interval. During the sweep from right to left the decoder 134 counts down from 7 to 0 twice, then counts down 8, then counts down by 7 two more times. Following that, the decoder 134 counts up by 14 to define the turnaround interval.

The output of the dot column decoder 134 for compressed print size is shown in greater detail in FIG. 5E. As seen therein the decoder 134 responds to each resync pulse by thereafter counting up in steps of 7, or 8 in the case of the third character, and then being reset to 0.

The character column decoder 136 is like the dot column decoder 134 in that it contains two different sets of PROMS one of which is selected by the character size signal from the input decoder 122. Each set of PROMS is designed to repeatedly count up to a predetermined number in response to the incrementally increasing output of the sync counter 114. Whereas the dot column decoder 134 identifies the different dot column positions of each character as the shuttle assembly 22 undergoes a sweep across the paper 11, the character column decoder 136 identifies each new chacter cell or column as the shuttle assembly 22 undergoes the sweep.

FIG. 4E shows the output of the character column decoder 136 in the case of standard character size, and FIG. 5D shows the same output in greater detail. As seen in FIG. 4E the output of the character column decoder 136 remains at "0" during the 12 dot column positions of the first character of the sweep, and then increases to "1" during the occurrence of the second character and then finally to "2" as the third character occurs. The output of the decoder 136 increases to "3" during the turnaround interval. Following that the output is reduced to "2" during the first character of the return sweep, to "1" during the second charcter of the return sweep and to "0" during the third character of the return sweep. The output of the decoder 136 is reduced to −1" during the following turnaround interval and is then reset at "0" as the next sweep from left to right occurs.

When the output from the input decoder 122 indicates printing of characters in compressed print size, the other set of PROMS within the character column decoder 136 is used, producing the result shown in FIG. 4G and in detail in FIG. 5F. As seen in FIG. 4G the output of the decoder 136 steps from "0" during the 7 dot column positions of the first character to "4" during the occurrence of the 5th character. The output of the decoder 136 increases to "5" during the following turnaround interval. During the return sweep from right to left the output of the decoder 136 is stepped down from "4" to "0" as the five different character cells or columns are passed through. The output of the decoder 136 is then reduced to "−1" during the following turnaround interval and is then raised to "0" as the next sweep from left to right begins.

Figures 6A, 6B, 6C, 6D:
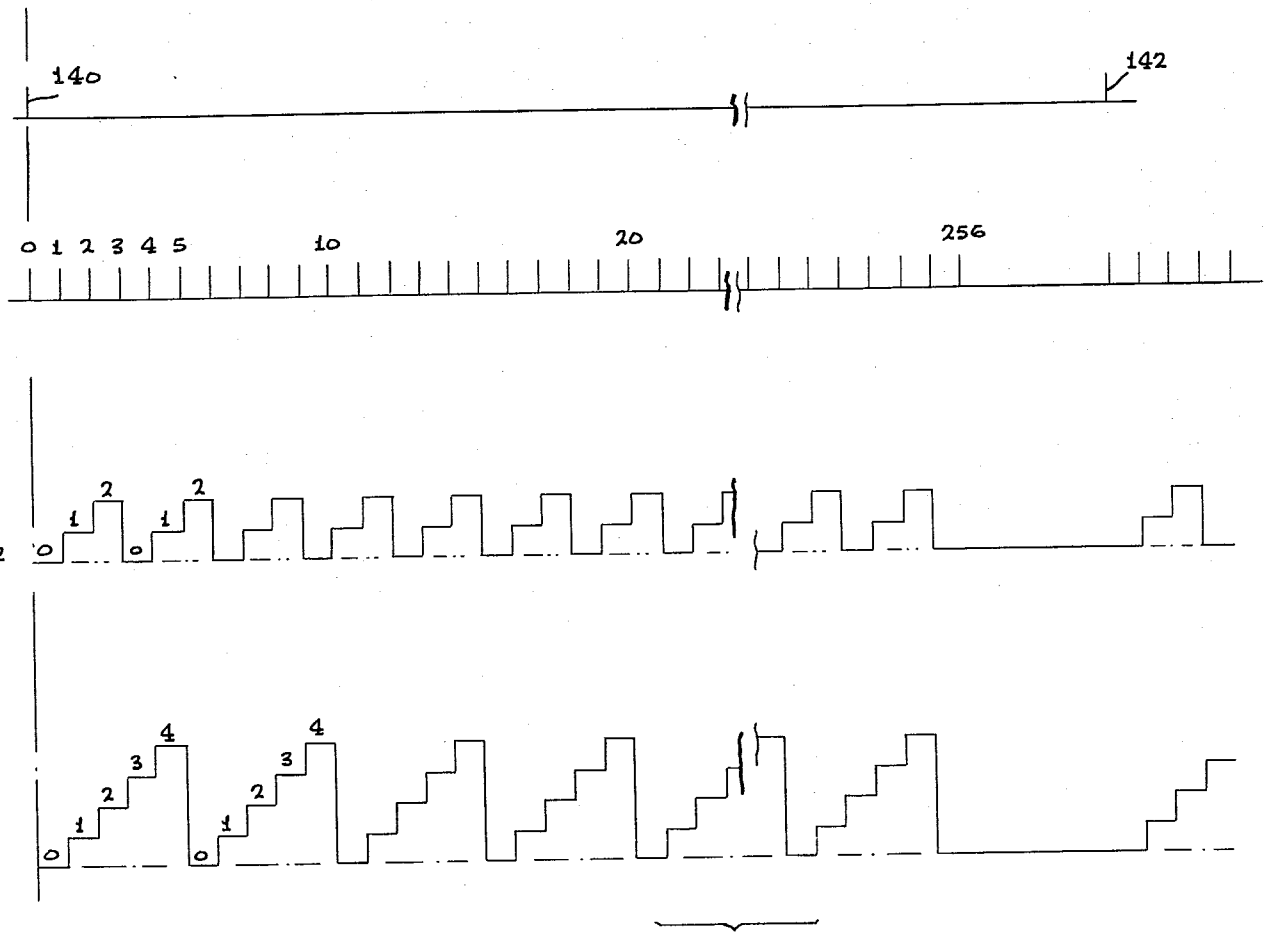
FIGS. 6A–6D are still further waveforms useful in explaining the operation of the circuitry of FIG. 3.

Referring again to FIG. 3 the magnetic pickup 102 is coupled to provide sync pulses to a 256 pulse generator 138 as well as the sync counter 114 and the missing pulse detector 108. The 256 pulse generator 138 responds to each sync pulse by generating 256 pulses prior to the occurrence of the next sync pulse. These pulses are provided both to the N modulo counter 132 and to the 256 character shift register 120. FIG. 6A depicts a sync pulse 140 and an immediately following sync pulse 142. FIG. 6B depicts the output of the 256 pulse generator 138 between the occurrence of the sync pulses 140 and 142. The 256 pulse generator 138 controls the examination of the entire line of characters to be printed each time a new dot column position is reached in response to generation of a sync pulse. The number 256 is an arbitrary one which is chosen so as to be at least equal to the maximum number of characters that can be printed in a line. In the present example the compressed print size of FIG. 2B allows the printing of up to 220 characters in a line across a paper just slightly over 13" in width. Accordingly a pulse generator producing pulses in excess of 220 or more specifically 256 was chosen.

The 256 pulse generator 138 controls recirculation of the 7-bit character-indicating bytes within the shift register 120 so as to present a different one of the bytes to the character generator 128 in response to each new pulse from the 256 pulse generator 138. Upon presentation of each 7-bit byte to the character generator 128, the character generator responds by outputing the modulation bits corresponding to a dot row of a selected group of modulation bits to a 1 of 12 multiplexer 144, the dot row being determined by the row counter 126. The character generator 128 stores two different sets of modulation bits for each possible character to be printed, one such set corresponding to the standard print size of FIG. 2A and the other set corresponding to the compressed print size of FIG. 2B. Selection of one of the two sets of bits in response to presentation of the 7-bit byte from the shift register 120 identifying that character is determined by the size indication from the input decoder 122. Thus, referring again to FIGS. 2A and 2B the character generator 128 stores a set of modulation bits corresponding to the dot pattern shown in FIG. 2A for the letter "A" and a second set of modulation bits corresponding to the compressed character "A" shown in FIG. 2B. Selection of one or the other of the two different sets of modulation bits is determined by the character size indication from the input decoder 122.

As previously noted the 256 pulse generator 138 causes all characters to be printed within a given line to be presented to the input of the character generator 128 as each new dot column position is entered by the shuttle assembly 22. As each 7-bit byte is presented to the input of the character generator 128 by the shift register 120 to the modulation bits defining a dot row as determined by the row counter 126 of the appropriate set of modulation bits for the character as determined by the character size signal from the input decoder 122 are provided to the 1 of 12 multiplexer 144. The 1 of 12 multiplexer 144 selects from the dot row the dot corresponding to the dot column position identified by the dot column decoder 134 to the exclusion of the other dots in the dot row for the character. Thus if the dot column decoder 134 determines that the shuttle assembly 22 is in the 3rd dot column position, the 1 of 12 multiplexer 144 responds by passing only the 3rd dot column position bit of each dot row outputed by the character generator 128 for each character in the shift register 120 to a gate 146 to the exclusion of the other bits. The 1 of 12 multiplexer must be capable of choosing from 12 different dot column positions of each dot row since in the case of the standard character size of FIG. 2A each character cell has 12 different dot column positions. In the compressed pring example of FIG. 2B the 1 of 12 multiplexer 144 must choose from either 7 or 8 different dot column positions within each dot row.

The modulation bits at the output of the 1 of 12 multiplexer 144 correspond to the dot column position as determined by the dot column decoder 134 for each of the three or five characters addressed by a given hammer. It is therefore necessary to determine which of the three or five characters the hammer is addressing at the particular instant that the sync pulse is generated to identify a particular dot column position. This is accomplished by the gate 146 in combination with the 256 pulse generator 138, the N modulo counter 132, the character column decoder 136 and a comparator 148. The comparator 148 has a pair of inputs coupled to the N modulo counter 132 and the character column decoder 136 and an output coupled to the gate 146. Referring again to FIG. 6B it will be recalled that the pulse generator 138 generates 256 pulses in response to each sync pulse. The N modulo counter which is coupled to the output of the 256 pulse generator 138 repeatedly counts up to a predetermined number in response to pulses from the pulse generator 138, the predetermined number which is 3 in the case of standard print size and 5 in the case of compressed print size bing determined by the output signal from the input decoder 122. FIG. 6C shows the output of the counter 132 in the case where the line is to be printed with standard size characters ($N=3$). It will be seen that the output of the counter 132 repeatedly steps through three different levels and is then reset as the pulses from the 256 pulse generator 138 occur. Since the characters occur in sequence for the given line at the output of the shift register 120 in response to the pulses from the pulse generator 138, it will be seen that the output of the N modulo counter 132 provides a representation of the positions of each group of three characters being printed by a particular hammer. According, a comparison of the output of the character column decoder 136 representing the 1 of 3 possible characters being addressed by each hammer with the output of theN modulo counter 132 as done by the comparator 148 insures that only the modulation bit for the character actually being scanned by a given hammer is passed by the gate 146 to a 44 bit serial-to-parallel converter 150. Thus, the gate 146 is opened each time the output of the character column decoder 136 as shown in FIG. 4E and FIG. 5D is equal to the output of the N modulo counter 132 as shown in FIG. 6.

Operation of the system for compressed print size printing is similar except that in any given instant one character out of the five must be identified instead of the one charater out of three. The N modulo counter 132 responds to the character size signal from the input decoder 122 to produce an output signal as shown in FIG. 6D. The gate 146 is opened whenever the comparator 148 determines that the output of the character column decoder 136 as shown in FIG. 4G and in FIG. 5F is equal to the output of the N modulo counter 132 as shown in FIG. 6D.

As the shift register 120 circulates the characters to be printed in a line past the input of the character generator 128 the gate 146 provides in sequence the desired modulation bit for each of the 44 hammers of the shuttle mechanism 22. The 44 modulation bits are accumulated in the 44 bit serial-to-parallel converter 150 which, when completely loaded, outputs the 44 modulation bits in parallel to the individual hammers 152 via latches and drivers 154 individually associated with the different hammers 152.

Whereas the present example of a printer in accordance with the invention provides the capability of printing a given set of characters in two different sizes, standard print size and compressed print size, it will be appreciated that a printer system capable of printing three or more different sizes can readily be provided in accordance with the principles of the invention. For example, it was previously noted in connection with the discussion of FIGS. 2A and 2B that the the portion of the print line shown in those figures and which is 36 dot column positions long could be divided into 4 character cells of 9 dot columns each. The circuitry of FIG. 3 could be modified to print such characters simply by adding another set of modulation bits to the character generator 128 for each character, by modifying the N modulo counter 132 to count when $N=4$ as well as 3 or 5 and by modifying the dot column decoder 134 and the character column decoder 136 to provide outputs of 9 counts and 4 counts respectively.

While the invention has been particularly shown and described with reference to preferred embodiments thereof, it will be understood by those skilled in the art that various changes in form and details may be made therein without departing from the spirit and scope of the invention.

What is claimed is:

1. A dot matrix printer capable of printing given characters in either of at least two different widths comprising the combination of:

means for feeding a printable medium incrementally through a printing line;

a reciprocable hammer bank disposed along said printing line and having a plurality of hammers spaced along the length thereof, each of the hammers including means for imprinting a dot when the hammer is impulsed toward the printing line position, said hammer bank being reciprocable along a selected length of printing line;

means coupled to reciprocate said hammer bank bidirectionally;

means for dividing the printing line into a dot matrix comprised of dot columns spaced along the width thereof and dot rows defining the height thereof, the reciprocable hammer bank sweeping through a different dot row with each reciprocation thereof;

means for determining the dot row through which the hammer bank is reciprocating;

means for generating synchronizing signals indicating the dot columns addressed by the hammers as the hammer bank reciprocates;

means for storing at least two different sets of modulation bits for each of a plurality of different possible characters to be printed, a first of the two different sets of modulation bits for each character comprising a dot matrix of first size and a second of the two different sets of modulation bits for each character comprising a dot matrix of second size different from the first size;

means for receiving indications of characters to be printed and an indication of desired character width;

means responsive to the indications of characters to be printed and the indication of desired character width for selecting one of the two different sets of modulation bits for each character to be printed from the means for storing in accordance with the indication of desired character width;

means responsive to the means for determining for selecting a row of modulation bits from the selected set of modulation bits for each character to be printed corresponding to the dot row through which the hammer bank is reciprocating;

means for selecting the bit in a selected dot column position for each selected row of modulation bits in accordance with the synchronizing signals and comprising a circuit arranged to repeatedly sequence in response to the synchronizing signals through a first or a second predetermined number of dot column positions in accordance with the indication of desired character width;

means for selecting the bits in certain of the selected dot column positions in accordance with the synchronizing signals to define selected character columns being addressed by the hammers and comprising a circuit arranged to repeatedly sequence in response to the synchronizing signals through a first or a second predetermined number of character column positions in accordance with the indication of desired character width;

means for applying said bits in certain of the selected dot column positions to impulse the hammers of the hammer bank;

the bit in a selected dot column position being selected for each of the characters to be printed in response to each synchronizing pulse; and the means for selecting the bits in certain of the selected dot column positions further comprising means for sequencing through a first or a second predetermined number of values in accordance with the indication of desired character width, and means for comparing the output of said circuit arranged to repeatedly sequence with the output of the means for sequencing through a first or a second predetermined number of values and selecting the bit of a selected dot column position whenever a comparison occurs.

2. A dot matrix printer capable of printing given characters in either of at least two different widths comprising the combination of:

a hammer bank having a plurality of actuable hammers spaced apart along the length thereof and each capable of printing a dot when actuated on a printable medium disposed adjacent thereto;

means for bidirectionally driving the hammer bank across the width of a printable medium, the hammer printing a different dot row across the printable medium with each pass of the hammer bank across the printable medium, each succession of R dot rows on the printable medium defining a character line;

means responsive to each pass of the hammer bank across the printable medium for generating a sequence of sync pulses, each sync pulse identifying a different dot column position across the pivotable medium;

recirculating shift register means coupled to receive representations of characters to be printed in a line and operative to recirculate the representations in response to each sync pulse;

means for storing an indication of the width of characters to be printed in a line;

a character generator for storing two different sets of modulation bits for each of a plurality of possible characters to be printed, a first of the two different sets of modulation bits defining a matrix of R x M dots and the second of the two different sets of modulation bits defining a matrix of R x N dots;

means for providing an indication of the dot column row to the character generator as the hammer bank passes through each of the R dot rows of each line, the character generator outputing the corresponding dot column row of one of the two different sets of modulation bits of the character corresponding to each representation upon each recirculation of the representation in the recirculating shift register means, the one of the two different sets of modulation bits being chosen in accordance with the stored indication of the width of characters to be printed;

dot column decoder means for repeatedly counting in response to the sync pulses to M or N as determined by the stored indication of the width of characters to be printed;

gating means;

multiplexer means coupled between the character generator and the gating means and responsive to the dot column decoder means for passing the dot column position represented by the count in the dot column decoder from each dot column row outputed by the character generator to the gating means;

means for actuating the hammer means in response to modulation bits passed by the gating means;

character column decoder means for repeatedly counting in response to each occurrence of M or N sync pulses as determined by the stored indication of the width of characters to be printed;

counter means for repeatedly counting in response to recirculation of the representations of characters in the shift register to U or V characters per sweep of the hammer bank as determined by the stored indication of the width of characters to be printed; and comparator means coupled to operate the gating means in accordance with a comparison of the outputs of the character column decoder means and the counter means.

3. The invention set forth in claim 2, wherein the printer is capable of printing up to W characters per line, further including a pulse generator for generating at least W pulses upon occurrence of each sync pulse and before the occurrence of the next sync pulse, the recirculating shift register means being operative to recirculate a different character representation in response to each pulse, and wherein the counter means counts pulses provided by the pulse generator.

4. The invention set forth in claim 3, wherein R is 7, M is $3\frac{1}{2}$, N is 6, U is 3, V is 5 and W is at least 220.

* * * * *

UNITED STATES PATENT AND TRADEMARK OFFICE

CERTIFICATE OF CORRECTION

PATENT NO. : 4,236,835

DATED : December 2, 1980

INVENTOR(S) : David W. Mayne and Raymond F. Melissa

It is certified that error appears in the above–identified patent and that said Letters Patent are hereby corrected as shown below:

Column 2, line 49, after "the" and before the period ("."), "hamers" should read --hammers--. Column 3, line 49, before "11", "medai" should read --media--; line 66, after "bank" and before "of", insert --23--. Column 4, line 62, after "the" and before "30", "reeld" should read --reels--. Column 7, line 29, after "sync" and before "occurs", "pylse" should read --pulse--. Column 9, line 53, after "new", "chacter" should read --character--. Column 10, line 2, after "to", " -1" " should read --"-1"--. Column 11, line 9, after "120" and before "the", strike "to"; line 28, "pring" should read --print--; line 52, after "size", "bing" should read --being--; line 65, "According" should read --Accordingly--. Column 12, line 11, after "of" (first occurrence) strike "the"; line 11, after "of" (second occurrence) strike "the"; line 12, after "one", "charater" should read --character--; line 39, after "the" (first occurrence) strike "the" (second occurrence). Column 13, line 36, after "position", "for" should read --from--.

Signed and Sealed this

*Twenty-fourth* Day of *March 1981*

[SEAL]

*Attest:*

RENE D. TEGTMEYER

*Attesting Officer*

*Acting Commissioner of Patents and Trademarks*